United States Patent [19]

Biardi

[11] 3,986,302

[45] Oct. 19, 1976

[54] DEVICE FOR FITTING A GRINDING WHEEL ONTO A GRINDING WHEEL SPINDLE

[75] Inventor: Giuseppe Biardi, Corsico (Milan), Italy

[73] Assignee: Norton Company, Worcester, Mass.

[22] Filed: Nov. 24, 1975

[21] Appl. No.: 634,662

[30] Foreign Application Priority Data

Nov. 12, 1974 Italy ..... 30420/74

[52] U.S. Cl. ..... 51/168

[51] Int. Cl.[2] ..... B24B 41/00

[58] Field of Search ..... 51/168

[56] References Cited

UNITED STATES PATENTS

| | | | |
|---|---|---|---|
| 881,691 | 3/1908 | Hughes | 51/168 |
| 1,162,970 | 12/1915 | Binford | 51/168 |
| 3,256,645 | 6/1966 | Holdash | 51/168 |

*Primary Examiner*—James L. Jones, Jr.
*Attorney, Agent, or Firm*—Walter Fred

[57] ABSTRACT

A grinding wheel mounting in which the wheel has a mounting hole of polygonal form into which is removably and coaxially inserted a corresponding polygonal shaped portion of an elastically deformable plastic body engaging the internal polygonal surfaces of the wheel. The body has a flange at one end in engagement with one side of the wheel and screw threads at its opposite end threadedly engaging with a slight interference fit, a threaded end portion of a grinding wheel spindle having an annular surface in clamping engagement with an opposite side of the grinding wheel. Upon screw threading the body together with the grinding wheel to the spindle, the grinding wheel is axially clamped beteen the flange on the body and the annular surface on the spindle and the body is slightly deformed radially by the interfering threaded portions thus eliminating axial and radial play, friction, slippage, wear and abrasion of the spindle threads.

21 Claims, 5 Drawing Figures

DEVICE FOR FITTING A GRINDING WHEEL ONTO A GRINDING WHEEL SPINDLE

BACKGROUND OF THE INVENTION

1. Field of Invention

The present invention relates to a device for fitting a grinding wheel onto a grinding wheel spindle of the type which comprises an insert associated with the said grinding wheel and provided with threaded elements screwed onto threaded counter-elements provided in the said spindle.

The device of this invention can be applied with particular advantage to the fitting of a small diameter grinding wheel to the end of a corresponding grinding wheel spindle used for internal grinding operations.

2. Description of Prior Art

Because of the high precision required for grinding operations, whether for rough or finish grinding, the fitting of a grinding wheel onto a corresponding grinding wheel spindle must be effected in such a manner as to achieve a perfect positioning of the grinding wheel on the said grinding wheel spindle, so as to ensure the absence of axial and/or radial play between the grinding wheel and the grinding wheel spindle.

The aforementioned precision in the fitting is of even greater importance in the case of internal grinding operations, when the grinding wheel spindle is carried projecting from the shaft of the grinding machine. Moreover, taking into account the relatively frequent operations involving the changing of a worn grinding wheel for a new grinding wheel of identical characteristics, and likewise, taking into account the considerable daily output normally expected of a grinding machine, particularly when the latter is one in a continuous production line of finished parts, the aforementioned fitting must be effected in such a manner, that these grinding wheel changing operations, can be carried out both speedily and accurately.

At present, the fitting of a grinding wheel to the end of a corresponding grindng wheel spindle is essentially carried out in accordance with the following known methods.

A. The grinding wheel spindle is coaxially extended at one end, by a tang of equal or lesser diameter, with which it forms an annular ledge. On this tang and against the annular ledge, a first annular washer is mounted; the grinding wheel is fitted on this tang, with one of its faces resting on this said first washer. A second annular washer is then mounted on the said tang, so that it rests against the other face of the grinding wheel. Finally, on a length of the said tang and accessible from the upper face of the said grinding wheel, a tightening nut is screwed on so as to press with predetermined force against the said second washer.

A first disadvantage of this conventional method resides in the fact that whenever a worn grinding wheel is changed for a new one of identical characteristics, it is necessary to dismount four parts (one worn grinding wheel, two washers and a screw-nut) and subsequently to mount another four parts (a new grinding wheel, two washers and a tightening nut). In consequence, such a changing operation calls not only for personnel with a certain amount of training, but also involves a relatively long period of time during which the grinding machine cannot operate. Such a relatively long interruption, apart from constituting by itself, a technical and economic inconvenience, can at times, require the stopping of the entire production line, for example in cases when the aforementioned changing operation of the grinding wheel cannot suitably be carried out at the time when the need for such a change is notified.

A further technical disadvantage lies in the fact that during the mounting and dismounting of the grinding wheel onto and from the said grinding wheel spindle, the abrasive material of the grinding wheel is in frictional contact with the said tang, on which it exerts an abrasive action. As a result of this, after a certain number of changes, the external diameter of the said tang decreases relatively to its original diameter, with resulting play between the tang and the grinding wheel, which is inadmissible in view of the precision required from such grinding operations. In this case, it becomes necessary to change the grinding wheel spindle.

B. The grinding wheel carrier spindle is provided at one end with an internally threaded blind hole. In the grinding wheel, there is incorporated a metal insert which forms a threaded tang jutting out from one of the faces of the said grinding wheel, coaxially with the grinding wheel itself. The mounting of such a grinding wheel on the grinding wheel spindle is effected by screwing the said threaded tang into the threaded blind hole of the said spindle.

A disadvantage of this conventional method resides in the fact that the metal insert — expensive to produce — forms an integral part of the associated grinding wheel, and must be discarded whenever the worn grinding wheel is changed.

Another disadvantage lies in the fact that this metal insert is generally fixed in the hole of the associated grinding wheel, by means of an appropriate cement which does not always withstand the stresses caused by the strong torques to which a grinding wheel is subjected during a grinding operation.

In U.S. Pat. No. 3,364,630 there is disclosed a wheel mounting wherein an abrasive roll made of a deformable foamed resin has a mounting hole of polygonal shape through which extends a drive spindle of corresponding shape. However, the abrasive roll is not adapted to be screw threaded to the end of the spindle as disclosed by the applicant.

U.S. Pat. No. 1,162,970 also discloses a wheel mounting comprising a grinding wheel having a noncircular aperture and recessed surface into which is inserted and fixed a flanged noncircular metal bushing of corresponding shape. Unlike the applicant's device the bushing has a square hole which receives the internally threaded square end of a drive spindle having an integral flange that clamps against the flange of the bushing. A screw threaded into the end of the spindle has a large head which clamps the grinding wheel axially against the integral flange on the spindle.

Applicant's device differs from the prior art discussed above in that the applicant provides a precision internal grinding wheel mounting comprising an elastically deformable, threaded insert or bush of polygonal form that is simultaneously rotatable with the grinding wheel for rapid attachment to and removal from a threaded end portion of the spindle, eliminates both radial and axial play in the mounting and protects the threads on the spindle from abrasion. Also, applicant's device has one less part and clamps the wheel both radially and axially between surfaces of the insert and spindle.

SUMMARY OF THE INVENTION

The problem which forms the basis of this invention is that of providing a device for mounting a grinding wheel at the end of a grinding wheel spindle, possessing structural characteristics such as will, at the same time, make it possible to overcome the disadvantages present in the conventional mounting methods, briefly described hereabove under points (A and B).

This problem has been solved according to the invention, by a device comprising:

— A conventional grinding wheel spindle provided with threaded elements,

— A grinding wheel axially provided with a through hole which in cross-section, is of polygonal form, — An extended body of resiliently deformable material, removably and coaxially inserted in the said hole, the said body having in cross-section, a polygonal form corresponding to the polygonal form of the cross-section of the said hole, and coaxially provided at one end, with a collar flange, the said body being, moreover, provided with threaded counter-elements capable of engaging by screwing, with the said threaded elements of the said grinding wheel spindle.

Further characteristics and advantages achieved by the device according to the invention, will be shown more clearly in the detailed description hereafter, and with reference to the appended drawings in which:

DESCRIPTION OF THE PREFERRED EMBODIMENT(S)

Figure 1:
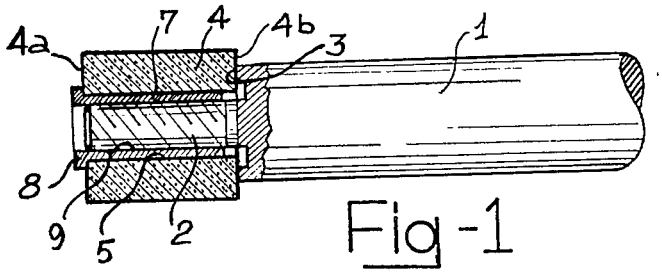
FIG. 1 shows in longitudinal section, a device according to the invention.
Figure 2:
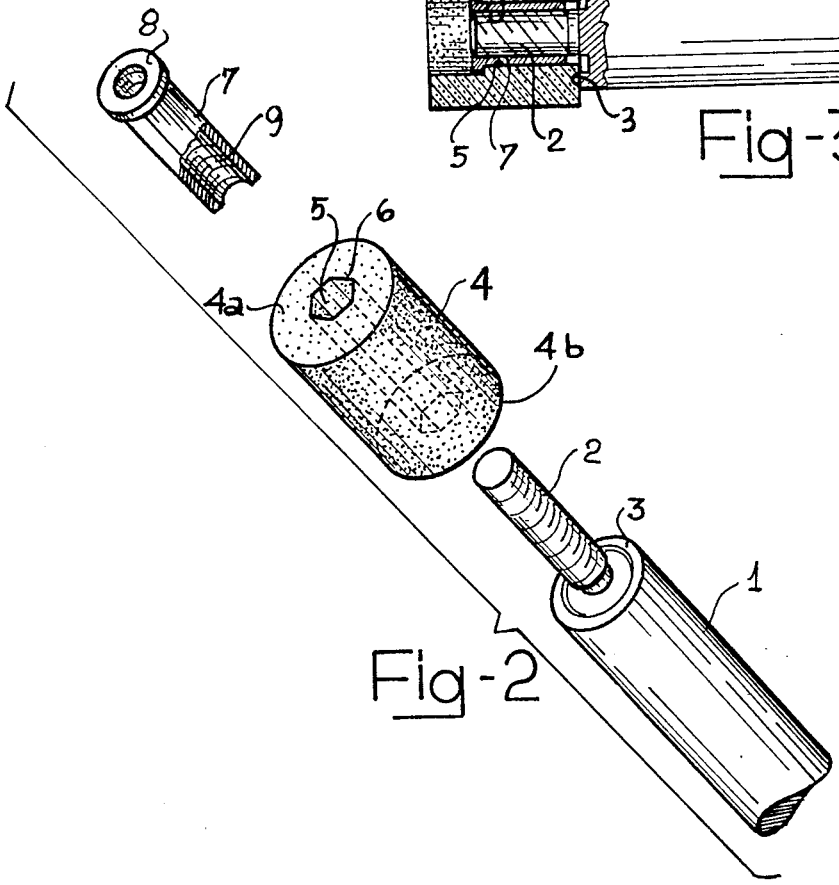
FIG. 2 shows a perspective and partly exploded view of the device illustrated in FIG. 1.

With reference to FIGS. 1 and 2, 1 is a grinding wheel spindle of conventional type, extended at one end by a threaded tang 2, having an external diameter less than the external diameter of the said spindle 1, and forming with the said spindle 1, an annular shoulder 3. 4 shows a small diameter grinding wheel of the type normally used for internal grinding operations. The said grinding wheel 4 is provided centrally with a hole 5 having in cross-section a polygonal form 6 (hexagonal in the Figures). 7 shows a bush made of elastically deformable material for example a suitable plastics material. The said bush 7 has, in cross-section, a polygonal form, (hexagonal in the Figures) corresponding with the cross-sectional shape of the said through hole 5 and provided at one end with a collar flange 8 whose external diameter is equal to or greater than the diameter of the circumference which circumscribes the polygonal form 6 at the mouth of the said hole 5 on the faces **4*a* or 4*b* of the said grinding wheel 4. The bush 7 is provided centrally with a hole 9 internally threaded with a threading which matches the threading of the said tang 2. The length of the said bush 7 within hole 5 is a little less than the length of the through hole 5 of the said grinding wheel 4. The bush 7 is inserted in the said hole 5 far enough for its flange collar 8 to rest against the face 4*a* of the grinding wheel 4. The mounting of the grinding wheel on the grinding wheel spindle 1 is effected simply by screwing the bush 7 on the threaded tang 2 of the grinding wheel spindle 1, until the face 4*b* comes to rest, pressing against the annular shoulder 3**.

Because provision is made to have available in the stores, a number of grinding wheels already equipped with their respective bushes 7, the operations for mounting and dismounting a grinding wheel on the end tang of a grinding wheel spindle, are considerably simplified and can be carried out with remarkable speed, to the point that the aforementioned operations can be made entirely automatic.

Once the mounting is effected, the coupling, hereabove described, between the bush 7 and the grinding wheel 4 is such that the said grinding wheel and related bush are practically one piece. It is because of the aforementioned coupling that this cohesion is maintained even during a grinding operation, for example an internal grinding operation, when the grinding wheel is subjected to considerable torque forces. Moreover, during a grinding operation, the locking of the grinding wheel 4, between the annular rim 3 formed in the grinding wheel spindle 1, and the collar flange 8 of the bush 7, is such that it ensures the absence of axial play between the grinding wheel 4 and the grinding wheel spindle 1, whilst radial play can be eliminated by the radial deformation of the bush 7 against the internal walls of the polygonal hole 5 of the said grinding wheel 4 obtained through a slight interference between the thread of the tang 2 and the thread of the bush 7. An additional advantage is provided by the fact that when changing a worn grinding wheel for a new one of identical characteristics, the threaded tang 2 of the grinding wheel spindle 1 does not come into contact with the abrasive material which constitutes the grinding wheel 4, but with the plastics material forming the bush 7. For this reason, the said threaded tang 2 is not exposed to any abrasive action during the aforementioned changing operation, therefore, the possibility of the development of unacceptable play between the said threaded tang and the bush 7 is eliminated. In these conditions, the grinding wheel spindle 1 has an indefinite working life.

Another advantage lies in the fact that when a grinding wheel 4 is discarded after reaching its limits of wear, the bush 7 can easily be recovered from the wheel, by threading it out of the through hole 5. Even though the said bush 7 might have to be discarded with the grinding wheel 4, the economic loss would be considerably limited because of the low production cost of such a bush.

Figure 3:
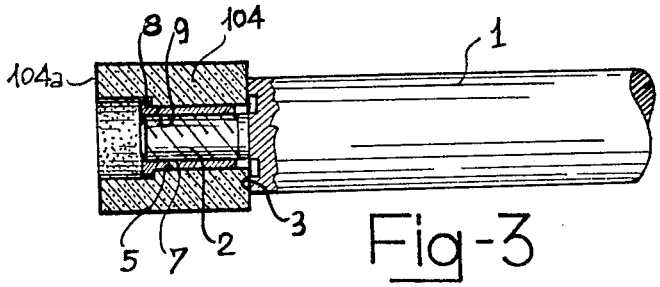
FIG. 3 shows in longitudinal section, a variation in the construction of the device illustrated in FIG. 1.

Not the least advantage is the fact that the bush 7 can be produced by the usual and well known moulding procedures which allow it to be provided, easily and economically, with an internal threading of even unusual type, to suit the application requirements. The grinding wheel 4 described with reference to FIGS. 1 and 2 is of the type whose working surface is formed by the cylindrical surface of the actual grinding wheel. In FIG. 3, where the same elements as shown in FIGS. 1 and 2, are defined with the same reference numbers, the grinding wheel 104 is of the type in which the working surface can be either the cylindrical surface or the front face **104*a* from which the flange collar 8 of bush 7 is axially spaced and engages a recessed shoulder or surface within a counterbored through hole 5**.

Figure 4:
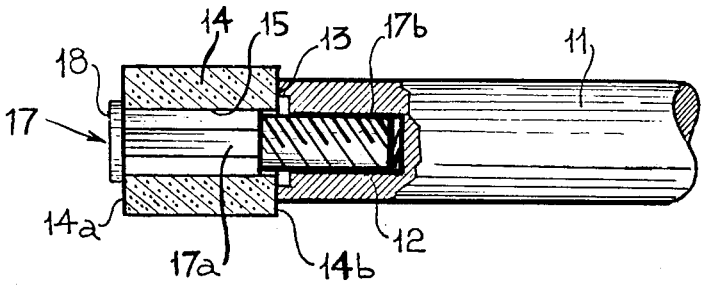
FIG. 4 shows in longitudinal section, a second variation in the construction of the device illustrated in FIG. 1.
Figure 5:
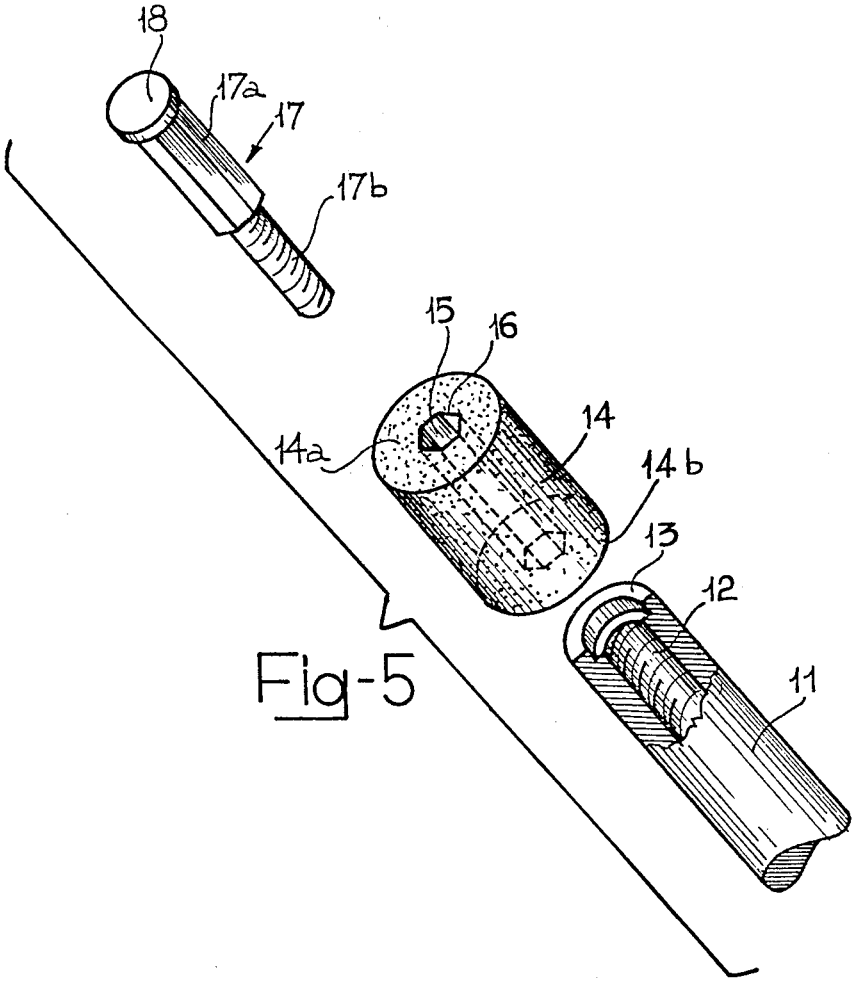
FIG. 5 shows in perspective and partly exploded, the device illustrated in FIG. 4.

FIGS. 4 and 5 shows a variation in the construction of the device of the invention. According to this variation, 11 shows a grinding wheel spindle of conventional type, coaxially provided at one end, with a blind hole 12 internally threaded, having a mouth which features at this end of the grinding wheel carrier spindle 11, an annular rim 13. 14 shows a grinding wheel of small diameter, for instance, of the type used for internal grinding operations. This grinding wheel is centrally provided with a hole 15 which has, in cross-section, a polygonal form 16 (hexagonal in the Figure). 17 shows an overall view of an extended element made of an elastically deformable material, for example a plastics material. The said element 17 is formed of a section 17*a* which has, in cross-section, a polygonal form matching the polygonal form 16 of the through hole 15 of the grinding wheel 14, and a threaded tang 17*b* which extends coaxially with the said polygonal section 17*a*. The threading of this tang 17*b* corresponds with that of the internal threading of the blind hole 12 of the said grinding wheel spindle 11, whilst the length of the section 17*a* is the same or slightly less than the length of the through hole 15 of the grinding wheel 14.

This polygonal section 17*a* is provided at its free end, with a collar flange 18 which has an external diameter greater than the diameter of the circumference which circumscribes the polygonal form 16 at the mouth of the said through hole 15 on the face 14*a* of the grinding wheel 14. When mounting the grinding wheel 14 on the grinding wheel carrier spindle, the procedure is first to insert the extended element 17 through the hole 15 of the grinding wheel 14, until the collar flange 18 of the said element 17 comes to rest against the face 14*a* of the actual grinding wheel. In this condition, the tang 17*b* of the said element 17 projects coaxially with the said grinding wheel 14 from the latter's face 14*b*. Subsequently this tang 17*b* is screwed into the blind hole 12 until the grinding wheel 14 is locked between the collar flange 18 and the annular rim 13 of the grinding wheel spindle 11.

Presently it is customary to place wheel blotters on the sides of a grinding wheel for mounting between flanges on a spindle.

Likewise, if desired the faces 4*b* of wheel 4, 104*b* of wheel 104 and 14*b* of wheel 14 are provided with either a thin plastic coating or a conventional wheel blotter or gasket, not shown, of relatively thin nonabrasive material attached thereto for clamping engagement with the annular shoulders 3 and 13 of the respective spindles 1 and 11. Thus, the annular shoulders 3 and 13 will engage the thin blotters or coatings and are thereby protected from abrasion and wear by the abrasive wheel.

As mentioned above the threaded elements 7 and 17 are preferably molded of a suitable elastically deformable plastic or organic polymer material. Examples of suitable plastic materials include organic polymers such as phenol aldehyde, nylon, polyester, polyacetal, acrylic, epoxy, polypropylene, polyethylene, polycarbonate and polytetrafluroethylene resins.

If desired the plastic material may be modified in the well known manner by the addition of various fillers such as particles and/or fibers of various inorganic, ceramic materials and metals which would upon being molded and cured provide reinforced plastic threaded elements 7 and 17.

In addition to plastic material there are various elastically deformable metals and alloys of such metal as aluminum, zinc, copper, tin and steel suitable for making the elements 7 and 17.

The elements 7 and 17 are preferably made to be assembled with a slight interference or snug fit with both the internal surfaces of the wheel within the polygonal hole and the threaded portions of the spindle. Thus, the amount of radial deformation of the material due to the slight interferences or snug fit between the assembled portions will be small and never exceed the elastic limit of the material. Due to the interference fit the elements 7 and 17 and wheels may be preassembled and thereby held together for subsequent attachment as a unit to the threaded spindle.

Applicant's wheel mounting made according to the invention has been tested and found to perform satisfactory during the internal grinding of highly precision cylindrical roller bearing races.

A typical wheel mounting for internal grinding of bearing races comprises, a vitrified bonded aluminum oxide abrasive internal grinding wheel approximately 16 mm. in diameter, 24 mm. in axial length, a hexagonal mounting hole of approximately 8 mm. measured between the flat surfaces, a counterbore approximately 11 mm. in diameter by 2 mm. deep at one end made in the conventional manner well known to those skilled in the art. A threaded element molded of a polyacetal resin such as that sold under the tradename HOSTAFORM manufactured by Hoechst of Germany was positioned in the hexagonal mounting hole. The threaded element had a hexagonal portion approximately 19 mm. in length, of substantially the same cross-sectional shape and size as the hexagonal mounting hole so it required a slight amount of force to push it into and out of the mounting hole and to keep it from falling out. The collar flange at one end of the hexagonal portion was approximately 2 mm. thick by 11 mm. in diameter, recessed within the counterbore and engaging the non-blottered abrasive recessed end surface of the wheel. The threaded portion of the element had 6 mm. × 1 mm. pitch internal threads in a threaded hole approximately 20 mm. deep closed at one end adjacent the collar flange. The threads were modified in the well known manner by varying the diameter of the threads so they had an interference fit with and mated tightly with 6 mm. external threads on the drive spindle.

The wheel was attached by hand turning the wheel which in turn screwed the threaded element to the shaft until the wheel was clamped firmly against an annular clamping surface of about 11 mm. in diameter on the spindle. During mounting, the interfering threads on the plastic threaded element are engaged by the threads of the spindle which together elastically deformed the plastic material radially into firm engagement with the internal surfaces within the mounting hole as well as between the threaded portion of the spindle. Thus the threaded element, positively driven by the spindle, positively drives the wheel without friction, abrasion, slippage or relative movement between the parts of the assembly. Obviously, the direction of rotation of the spindle is such that the grinding forces act in a direction tending to tighten and maintain the wheel clamped against the spindle without looseness.

It is to be understood that the applicant's invention is not limited to the specific dimensions, shapes and sizes described above by the example and can be made to any of the special or standard sizes, shapes or grades of internal grinding wheels and wheel drive spindles presently in use.

What is claimed is:

1. A grinding wheel mounting comprising:
a spindle having
a threaded end portion including screw threads, and a clamping surface extending radially adjacent the screw threads in clamping engagement with one side of the grinding wheel;
a grinding wheel having
a central mounting hole of polygonal cross-sectional shape extending axially between opposite sides of the wheel; and
a threaded element made of elastically deformable material removably and coaxially inserted in the mounting hole and having
a polygonal portion corresponding to the polygonal cross-sectional shape of the mounting hole extending axially and engaging the internal surface of the wheel within the mounting hole,
a collar flange integral with and extending radially from one end of the polygonal portion in clamping engagement with a surface of the wheel adjacent one end of the mounting hole of polygonal shape situated opposite the side of the wheel engaging the clamping surface of the spindle, and
screw threads adjacent an opposite end of the polygonal portion threadedly engaging the threaded end portion of the spindle and clamping the wheel axially between the collar flange and the clamping surface on the threaded end portion of the spindle.

2. A grinding wheel mounting according to claim 1 wherein the spindle comprises:
an externally threaded end portion extending coaxially from the clamping surface; and
wherein the threaded element comprises:
a shoulder bushing having
a threaded hole extending coaxially from the end of the polygonal portion and adapted to receive the externally threaded end portion of the spindle.

3. A grinding wheel mounting according to claim 1 wherein the spindle comprises:
a threaded hole extending coaxially from the radial clamping surface at an end of the threaded end portion; and
wherein the threaded element comprises:
an externally threaded portion, integral with and extending coaxially from the polygonal portion, adapted for threading into the threaded hole in the spindle.

4. A grinding wheel mounting according to claim 1 wherein the polygonal portion of the threaded element has
an axial length no greater than that of the mounting hole of polygonal form.

5. A grinding wheel mounting according to claim 1 wherein the grinding wheel further comprises:
a counterbore extending coaxially from one side of the wheel to a recessed surface of the wheel adjacent one end of the mounting hole of polygonal shape; and
wherein the polygonal portion and adjacent collar flange of the threaded element have a total axial length no greater than that of the grinding wheel, and the collar flange is recessed into the one side and engages the recessed surface of the wheel.

6. A grinding wheel mounting according to claim 1 wherein the screw threads on the threaded element have
an interference fit with screw threads on the threaded end portion of the spindle whereby the threaded element is deformed into firm engagement therewith, without relative movement therebetween.

7. A grinding wheel mounting according to claim 2 wherein the shoulder bushing further comprises:
screw threads in the threaded hole having an interference fit with the screw threads on the externally threaded end portion of the spindle whereby the polygonal portion of the bushing is deformed radially into firm engagement, without relative movement, with both the internal surface of the wheel within the mounting hole and the spindle.

8. A grinding wheel adapted to be threaded to and axially clamped against a radial clamping surface on a threaded end portion of a wheel spindle comprising:
a grinding wheel having
a central mounting hole of polygonal cross-sectional shape extending axially between opposite sides of the wheel; and
a threaded element made of elastically deformable material removably and coaxially inserted in the mounting hole and having
a polygonal portion corresponding to the polygonal cross-sectional shape of the hole extending axially and engaging the internal surface of the wheel within the mounting hole,
a collar flange integral with and extending radially outward from one end of the polygonal portion for clamping engagement with a surface of the wheel adjacent one end of the mounting hole of polygonal shape, and
screw threads adjacent an opposite end of the polygonal portion adapted for threadedly engaging the threaded end portion of the spindle and clamping the wheel axially between the collar flange and the radial surface on the threaded end portion of the spindle.

9. A grinding wheel according to claim 8 wherein the threaded element comprises:
a shoulder bushing having
a threaded hole adapted to receive an externally threaded end portion of the wheel spindle extending coaxially from the radial clamping surface.

10. A grinding wheel according to claim 8 wherein the threaded element comprises:
an externally threaded portion, integral with and extending coaxially from the polygonal portion, adapted for threading into a threaded hole extending coaxially from a radial clamping surface at an end of the threaded end portion of the spindle.

11. A grinding wheel according to claim 8 wherein the polygonal portion of the threaded element has
an axial length no greater than that of the mounting hole of polygonal form.

12. A grinding wheel according to claim 8 wherein the grinding wheel further comprises:
a counterbore extending coaxially from one side of the wheel to a recessed surface of the wheel adjacent one end of the mounting hole of polygonal shape; and
wherein the polygonal portion and adjacent collar flange of the threaded element have a total axial length no greater than that of the grinding wheel, and the collar flange is recessed into the one side and engages the recessed surface of the wheel.

13. A grinding wheel according to claim 8 wherein the screw threads on the threaded element have an interference fit with screw threads on the threaded end portion of the spindle whereby the threaded element is deformed into firm engagement, therewith without relative movement therebetween.

14. A grinding wheel according to claim 9 wherein the shoulder bushing further comprises:

screw threads in the threaded hole having an interference fit with the screw threads on the externally threaded end portion of the spindle whereby the polygonal portion of the bushing is deformed radially into firm engagement, without relative movement, with both the internal surface of the wheel within the mounting hole and the spindle.

15. A device for mounting a grinding wheel having a central mounting hole of polygonal cross sectional shape extending axially between opposite sides of the wheel to a threaded end portion of a grinding wheel spindle having screw threads and a clamping surface extending radially adjacent the threads for clamping engagement with a portion of one side of the grinding wheel comprising:

a threaded element of elastically deformable material having a polygonal portion corresponding substantially to the polygonal cross-sectional shape and size of the central mounting hole and adapted to be removably and coaxially inserted into engagement with the internal surface of the wheel within the mounting hole;

a collar flange, integral with and extending radially outward from one end of the polygonal portion, for clamping engagement with a surface adjacent one end of the mounting hole of polygonal shape; and screw threads adjacent an opposite end of the polygonal portion adapted for threadedly engaging the threaded end portion of the spindle and clamping the wheel axially between the collar flange and the clamping surface on the threaded end portion of the spindle.

16. A device for mounting a grinding wheel according to claim 15 wherein the threaded element comprises:

a shoulder bushing having a threaded hole adapted to receive an externally threaded end portion of the spindle extending coaxially from the clamping surface.

17. A device for mounting a grinding wheel according to claim 15 wherein the threaded element comprises:

an externally threaded portion, integral with and extending coaxially from the polygonal portion, adapted for threading into a threaded hole extending coaxially from a clamping surface at an end of the threaded end portion of the spindle.

18. A device for mounting a grinding wheel according to claim 15 wherein the polygonal portion of the threaded element has an axial length no greater than that of the mounting hole of polygonal form.

19. A device for mounting a grinding wheel according to claim 15 wherein the polygonal portion and adjacent collar flange of the threaded element have a total axial length no greater than that of the grinding wheel.

20. A device for mounting a grinding wheel according to claim 15 wherein the screw threads on the threaded element have an interference fit with screw threads on the threaded end portion of the spindle whereby the threaded element will be deformed into firm engagement therewith without relative movement therebetween.

21. A device for mounting a grinding wheel according to claim 16 wherein the shoulder bushing further comprises:

screw threads in the threaded hole having an interference fit with the screw threads on the externally threaded end portion of the spindle whereby the polygonal portion of the bushing will be deformed radially into firm engagement, without relative movement, with both the internal surface of the wheel within the mounting hole and the spindle.

* * * * *